US010545008B2

(12) United States Patent
Noble

(10) Patent No.: US 10,545,008 B2
(45) Date of Patent: Jan. 28, 2020

(54) CONCEALED CARRY GUN BELT WITH "J" HOOK POCKET

(71) Applicant: Dennis William Noble, Suisun City, CA (US)

(72) Inventor: Dennis William Noble, Suisun City, CA (US)

( * ) Notice: Subject to any disclaimer, the term of this patent is extended or adjusted under 35 U.S.C. 154(b) by 0 days.

(21) Appl. No.: 15/418,732

(22) Filed: Jan. 29, 2017

(65) Prior Publication Data

US 2017/0254617 A1 Sep. 7, 2017

Related U.S. Application Data

(60) Provisional application No. 62/303,921, filed on Mar. 4, 2016.

(51) Int. Cl.
*F41C 33/00* (2006.01)
*F41C 33/04* (2006.01)

(52) U.S. Cl.
CPC ..... *F41C 33/041* (2013.01); *F41C 33/008* (2013.01); *F41C 33/046* (2013.01)

(58) Field of Classification Search
CPC ..... A45C 3/005; A45C 3/14; A45C 2003/144; A45C 2005/008; F41C 33/04; F41C 33/041; F41C 33/043; F41C 33/045; F41C 33/046; F41C 33/048
USPC ..... 2/311–321; 224/587, 666, 667
See application file for complete search history.

(56) References Cited

U.S. PATENT DOCUMENTS

| | | | | | |
|---|---|---|---|---|---|
| D29,490 | S | * | 10/1898 | Varni | D3/230 |
| 802,558 | A | * | 10/1905 | Gaisman | A41F 9/002 2/322 |
| 4,446,574 | A | * | 5/1984 | Kalomeris | A45C 1/04 2/247 |
| 4,461,030 | A | * | 7/1984 | Knudsen | A45C 1/04 2/22 |
| 5,023,956 | A | * | 6/1991 | Fox | A41D 27/08 2/311 |
| D347,733 | S | * | 6/1994 | Miller | 224/221 |
| 5,341,972 | A | * | 8/1994 | Jacks | A45C 1/04 224/165 |
| 5,558,440 | A | * | 9/1996 | Miller | A45C 1/04 224/219 |
| 7,574,753 | B1 | * | 8/2009 | Seyfried | A41D 27/085 2/311 |
| 8,510,868 | B2 | * | 8/2013 | Mongan | F41C 33/046 2/300 |
| D692,655 | S | * | 11/2013 | Perrea | D3/226 |
| 2003/0121946 | A1 | * | 7/2003 | Tai | A41F 9/002 224/587 |
| 2003/0189076 | A1 | * | 10/2003 | Shapess | A45C 1/04 224/587 |
| 2007/0084895 | A1 | * | 4/2007 | Bowen | A45C 1/04 224/660 |
| 2013/0048687 | A1 | * | 2/2013 | Do | A45F 3/14 224/222 |

* cited by examiner

*Primary Examiner* — Joshua E Rodden

(57) ABSTRACT

The present invention relates to a gun belt with an integrated holster retention system where by a holsters "J", "M" or similar style hook sits in a pocket formed by the belts outer layer and attached narrower bottom inner layer. The hook than engages the upper layer thus holding the holster in place.

4 Claims, 1 Drawing Sheet

FIG 1
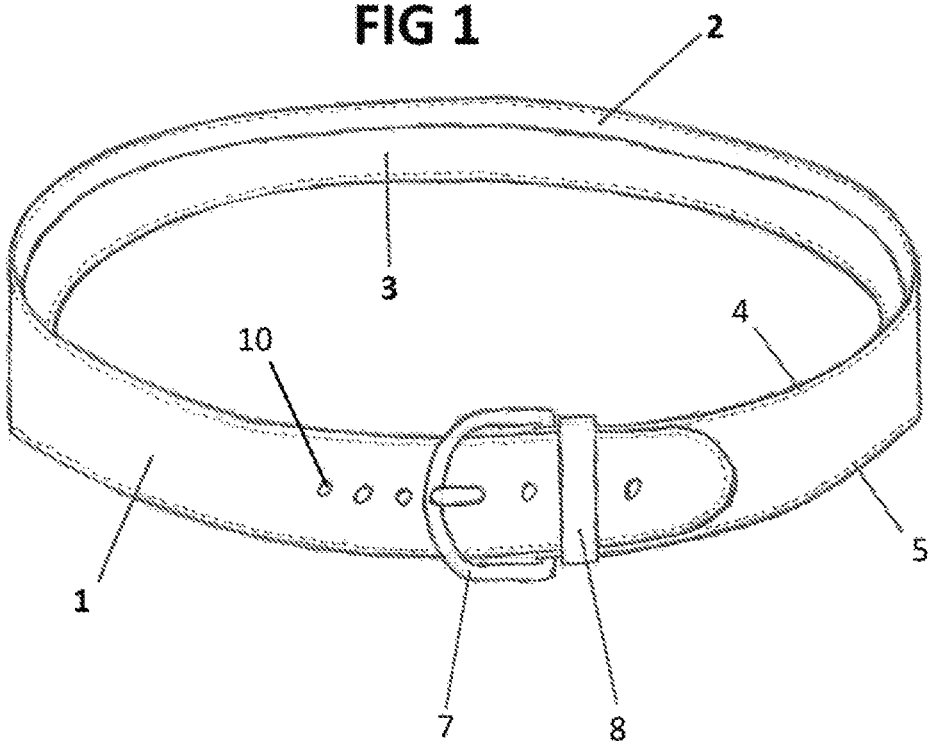
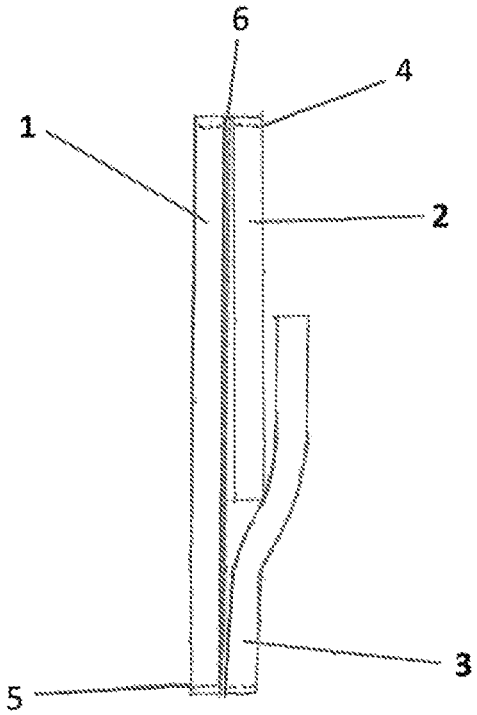
FIG 2
FIG 3
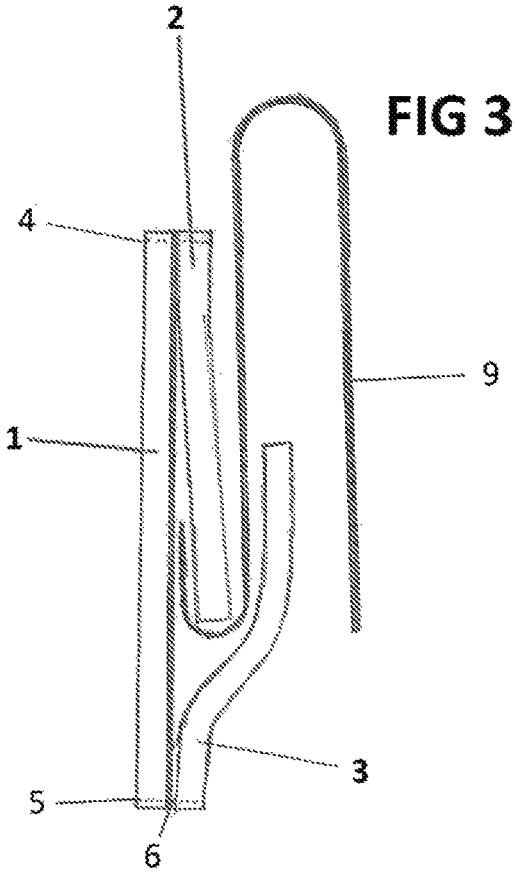

CONCEALED CARRY GUN BELT WITH "J" HOOK POCKET

CROSS-REFERENCE TO RELATED APPLICATIONS

This application claim benefit of provision application 62/303,921 filed on Mar. 4, 2016.

BACKGROUND OF THE INVENTION

Over the years there have been many belts designed to better assist in carrying firearms or other items in a concealed manor. Most prior art gun belts on the market are not much different from standard garment belts available at any clothing store, they are just thicker and stiffer to better distribute the weight of the firearm being carried. The problem with all prior art gun belts comes when you go to attach a holster or other item to it. To properly transmit weight from the holster to the belt you need a clip or hook to go over the belt, while this works for that purpose the clip is highly visible. One alternative is to use a "J" or "M" style holster hook where the hook goes up and over the waist band of the pants and than goes down behind the belt before curving up to hook on the belts bottom edge. While this works to conceal the hook, weight is no longer transmitted to the belt but instead it goes to the soft flexible waist band of the pants thus allowing the holster and fire arm to shift out of place and possibly become inaccessible. Still others have attempted to solve this problem using holster clips and belts with hook and loop fastener material (Velcro) to cohesively attach the two. The problem with this is that it requires special hooks on the holster to attach it to the belt which may not be available for your specific holster. Another problem is that the majority of prior art belts using this type of attachment are law enforce duty style belts that are very bulky and may not fit in the belt loops of ordinary pants. While law enforcements duty belts are well suited to their purpose their size and purely functional aesthetics make them unsuitable as civilian gun belts.

In conclusion there is a need for a gun belt that is able to bear the weight of a loaded firearm or similar size/weight item while releasably retaining a commonly available style hook of said fire arms holster thus preventing it from moving around while allowing said hook to remain hidden from view.

SUMMARY

It is the objective of the present invention to provide a releasable holster attachment system for daily wear and concealed carry of a firearm or other item.

It is also the objective of the invention to maintain the holster in a fixed position to allow easier & faster acquisition of the firearm or similar item.

Additionally it is the objective of the invention to be compatible with existing holster "J", "M" or similar style clips already on the market eliminating the need to modify an existing holster.

Further it is the objective of the invention to conceal a holsters clips from view enhancing the wearers ability to keep their firearm or similar item concealed.

Another objective of the invention is to bear the weight of a firearm or similar item without deforming or becoming uncomfortable on the wearer.

DRAWINGS

FIG. 1 is a perspective view of the belt in accordance with the present invention.

FIG. 2 is a cross sectional view.

FIG. 3 is a cross sectional view shown with a holster "J" hook in place for reference purposes and inner layers spread open in a slightly exaggerated manner for clarity.

INDEX 1

Outer layer. Made of leather, nylon webbing or similar material. It is the primary load bearing component of the belt.

INDEX 2

Top inner layer. Made of leather, nylon webbing or similar material. It is the component of the belt that the holsters hook engages to give it positive retention.

INDEX 3

Bottom inner layer. Made of leather, nylon webbing or similar material. It is the component of the belt that the holsters hook sits down in to to transmit weight from the holster to the belts outer layer (Index 1).

INDEX 4

Thread to attach top inner layer (index 2) to outer layer (Index 1).

INDEX 5

Thread to attach bottom inner layer (Index 3) to outer layer (index 1).

INDEX 6

Thin layer of nylon, spring steel or similar material. Gives belt stiffness.

INDEX 7

Belt buckle.

INDEX 8

Belt loop to secure loose end of belt.

INDEX 9

Holster "J" hook. shown for reference purposes only.

INDEX 10

Holes for belt buckle (Index 7).

DETAILED DESCRIPTION

This belt is primarily designed and built with concealed carry of firearms on ones person in mind though it could be used to carry other items of similar size and weight as well.

The belt is comprised of an outer layer of leather, nylon webbing or other similar material running the full width and length of the belt with a sufficient amount of excess at one end to allow attaching the buckle. This outer layer is backed by a (middle) layer of extruded nylon 6/6 or similar material that is the full width of the belt and runs the length of the belt starting just after the buckle attachment area and ending just before the portion of the loose end containing the holes that engage the buckle after the belt is put around the users waist. The purpose of this middle layer is to stiffen the belt and prevent it from stretching and/or distorting over time. Stitched or other wise attached along the bottom edge of the belt with aramid (AKA Kevlar), nylon or similar type of thread is the inner bottom layer. This layer is approximately ⅔rds the width of the outer and middle layers and runs the length of the belt starting just after the buckle attachment area (where the middle layer also starts) and runs all the way to the opposite (loose) end of the belt. This layer works in conjunction with the outer and middle layers to form the base of the "J" Hook Pocket. Similar to that layer is the inner top layer which is stitched or other wise attached along the top edge of the belt with aramid, nylon or similar type of thread. the inner top layer is also approximately ⅔rds the width of the outer layer and runs the length of the belt starting just after the buckle attachment area (where the middle and inner bottom layers start) and runs all the way to the opposite (loose) end of the belt just as the inner bottom layer does. The inner top layer is tucked behind the inner bottom layer and engages the tip of a firearm holsters "J" or "M" style hook and acts as the primary retention component of the belt keeping the holsters hooks in place while remaining out of view behind the belt.

The belt is worn around the users waist through the belt loops on their pants just like a standard garment belt is worn. An "In The Waist Band" style firearm holster is than placed inside the users pants waistband with the "J", "M" or similar style hooks going up and over the top of the waist band and behind the belt like they would normally do with this style of holster on a standard gun belt. What sets this belt apart from any other gun belt on the market is that the holsters hooks rather than going all the way down behind the belt and hooking underneath (leaving the tips of the hooks exposed) it is instead inserted into the pocket on the back of the belt created by the Inner bottom and outer layers. The inner top layer is than pulled up over the tip of the holsters hook providing retention of the holster through the hooks. This design transmits the weight of the firearm or other item being carried and its holster to the belt and not the users pants waist band. The advantages to this design are that the weight of the firearm and holster will not cause it to sag down, move or rotate out of position thus inhibiting easy and rapid access to the firearm. The second advantage is that the hooks of the holster are far less likely to inadvertently disengage from the belt which can allow the holster to be pulled out of the pants waist band and stay on the firearm when it is drawn thus interfering with the proper operation of the firearm in an emergency.

What is claimed is:

1. A daily wear belt in combination with a holster equipped with at least one hook to carry a firearm or other item of similar size and weight while said belt keeps said at least one hook concealed from view and retained by the belt, the belt comprising: an elongated outer layer of constant thickness to act as a primary load bearing and aesthetic component; a permanently attached middle layer running a full length and width of said elongated outer layer providing increased rigidity about a lateral axis as well as resistance to stretching longitudinally; an inner top layer permanently attached on a top edge only and even with a top edge of the outer layer running the full length and two thirds of the width of the elongated outer layer; an inner bottom layer permanently attached on a bottom edge only and even with a bottom edge of the outer layer running the full length and two thirds of the width of the elongated outer layer there for overlapping the inner top layer in a middle of the belt; a buckle for securing the belt around the wearers waist; whereby the at least one hook is configured to be supported by both the inner top and bottom layers.

2. The belt as described in claim 1, where the at least one hook sits down in a pocket formed by the outer and inner bottom layers.

3. The belt as described in claim 1, where the at least one hook is in the form of one of a "J" or "M" style hook, and the at least one hook is configured to be releasably retained by engaging the inner top layer of the belt.

4. The belt as described in claim 2, where the weight of the firearm or other item of similar size is transmitted from the at least one hook to the belt by way of the pocket.

* * * * *